US005271231A

United States Patent [19]

Ha et al.

[11] Patent Number: 5,271,231

[45] Date of Patent: Dec. 21, 1993

[54] METHOD AND APPARATUS FOR GAS LIQUEFACTION WITH PLURAL WORK EXPANSION OF FEED AS REFRIGERANT AND AIR SEPARATION CYCLE EMBODYING THE SAME

[75] Inventors: Bao Ha, Vacaville, Calif.; Jean P. Tranier, Champigny sur Marne, France

[73] Assignees: l'Air Liquide, Societe Anonyme pour l'Etude et l'Exploitation des Procedes Georges Claude, Paris, France; Liquid Air Engineering Corporation, Montreal, Canada

[21] Appl. No.: 926,406

[22] Filed: Aug. 10, 1992

[51] Int. Cl.[5] ..... F25J 3/00

[52] U.S. Cl. ..... 62/39; 62/9

[58] Field of Search ..... 62/9, 39

[56] References Cited

U.S. PATENT DOCUMENTS

| | | | |
|---|---|---|---|
| 3,358,460 | 12/1967 | Smith et al. | 62/9 |
| 3,677,019 | 7/1972 | Olszewski | 62/9 |
| 4,267,701 | 5/1981 | Toscano | 62/86 |
| 4,539,028 | 9/1985 | Paradowski et al. | 62/9 |
| 4,636,639 | 1/1987 | Marshall et al. | 62/9 |
| 4,638,638 | 1/1987 | Marshall et al. | 62/9 |
| 4,846,862 | 7/1989 | Cook | 62/9 |
| 4,894,076 | 1/1990 | Dobracki et al. | 62/9 |

FOREIGN PATENT DOCUMENTS 2011058 7/1979 United Kingdom .

*Primary Examiner*—Ronald C. Capossela

*Attorney, Agent, or Firm*—Young & Thompson

[57] ABSTRACT

A method of liquefying a low-boiling gas, in which gas is compressed to a high pressure, is cooled in heat exchange structure and is isenthalpically expanded to condense a portion of the same to liquid. The liquid being separated from residual gas and the residual gas is used to cool the heat exchange structure and is then recycled. A portion of the gas is compressed to an intermediate pressure between the high and low pressures, is isentropically expanded at a first temperature and is used to cool a relatively warm portion of heat exchange structure and is then recycled. A portion of the high pressure gas is isentropically expanded at a second temperature and used to cool a relatively cool portion of the heat exchange structure and then again isentropically expanded at a third temperature to that low pressure and returned through the heat exchange structure to cool the same and is then recycled. That first temperature is higher than the second temperature and that second temperature is higher than the third temperature. The gas is preferably nitrogen. The cycle can be part of an air separation unit, whose low pressure nitrogen product is make-up for the liquefaction cycle and whose high pressure nitrogen product is merged with the low pressure cycle gas.

39 Claims, 9 Drawing Sheets

METHOD AND APPARATUS FOR GAS LIQUEFACTION WITH PLURAL WORK EXPANSION OF FEED AS REFRIGERANT AND AIR SEPARATION CYCLE EMBODYING THE SAME

FIELD OF THE INVENTION

The present invention relates to the liquefaction of low-boiling gases with plural work expansions of portions of the feed to produce the refrigeration necessary to cool the remainder of the feed by countercurrent heat exchange.

BACKGROUND OF THE INVENTION

The liquefaction of a low-boiling gas is effected by compression and cooling and then expansion to reduce its temperature to the liquefaction temperature. It is of course not economical to cool the compressed feed to the necessary liquefaction temperature solely by Joule-Thomson expansion; and so for many years it has been standard procedure to divide the feed and expand a portion of it isentropically and use the refrigeration thus produced to cool the remainder of the feed by countercurrent heat exchange.

But the low-boiling gases do not cool with constant change of enthalpy per unit decrease in temperature. Instead, the cooling curves of the low-boiling gases are what is known in the art as "S-curves".

On the other hand, when warming, the low-boiling gases do not retrace this same S-curve but rather tend to follow a warming "curve" that in fact is substantially rectilinear.

It is also a well-known principle in this art, that the greatest thermodynamic efficiency, and hence the least cost of the work necessary to perform the compression from which the required refrigeration is derived, is promoted by maintaining the temperature difference between the warming and cooling streams during indirect heat exchange, as small as possible over the entire length of the heat exchange means. But this is impossible in the case described above, in which an S-shaped cooling curve is juxtaposed with a rectilinear warming curve: the distance between the two curves cannot be kept to a minimum, because the curves depart quite markedly from congruency. This situation, a familiar bane to designers in this field, is shown schematically in FIG. 1 of the attached drawings.

The Known Prior Art

As the cooling curve of the low-boiling gases cannot be changed, designers in this field have sought to change the warming curve, by redistributing the refrigeration provided by a work expanded portion of the feed stream, along intermediate portions of the heat exchange path. Specifically, it is known to expand a portion of the feed isentropically and to apply the refrigeration thus produced to the remainder of the feed along only a portion of the heat exchange path intermediate the cold and warm ends thereof, and then further isentropically to expand this same portion prior to returning it along the heat exchange means to the warm end thereof.

Thus, in Smith et al. U.S. Pat. No. 3,358,460, a high pressure feed stream is progressively cooled and then isenthalpically expanded to liquefy the same, a portion of this high pressure stream being isentropically expanded, returned in countercurrent heat exchange with the remainder of the feed at an intermediate temperature level, and then again isentropically expanded before being returned in countercurrent heat exchange to the feed, to the warm end of the heat exchange means.

But as these two isentropic expansions are insufficient to produce the required refrigeration, a separate external refrigeration unit is provided which must, however, operate at a relatively low temperature of about −74° C. Such a low temperature requires the use of very expensive external refrigerant; and the refrigeration unit becomes very expensive, as cryogenic materials must be used.

Marshall et al. U.S. Pat. No. 4,638,639 proposes another arrangement for seeking to render the warming curve congruent with the cooling curve. In this latter patent, a dual pressure cycle is provided, in which the feed is at relatively high pressure and a second stream is compressed to intermediate pressure. A portion of the high pressure stream is isentropically expanded, used to cool the feed at an intermediate temperature level, again isentropically expanded and returned, in countercurrent heat exchange with the feed, to the warm end of the heat exchange means. But instead of an external refrigeration unit as in Smith et al., Marshall et al. provides two further isentropic expansions. In a warmer one of these, a portion of the high pressure feed, at a higher temperature level than the first-mentioned portion of the high pressure feed, is isentropically expanded and returned to cool a warmer portion of the heat exchange means than the first-mentioned feed portion. Also, however, the intermediate pressure stream is cooled to a still lower temperature than the first-mentioned portion of the high pressure stream, and is isentropically expanded and returned to cool a cooler portion of the heat exchange means than the first-mentioned portion.

In other words, in Marshall et al., three portions of the feed are isentropically expanded at three different temperature levels and used initially to cool three different portions of the heat exchange means at three correspondingly different temperature levels. At least four expansion engines are thus required. This increases the complexity of the cycle significantly and also results in higher capital costs.

Finally, in Dobracki et al. U.S. Pat. No. 4,894,076, a cycle is proposed in which an intermediate pressure stream is divided and a relatively warm portion is isentropically expanded to provide refrigeration at a relatively high temperature level and a relatively cold portion is isentropically expanded to provide refrigeration at a relatively low temperature level.

OBJECTS OF THE INVENTION

It is accordingly an object of the present invention to provide a method and apparatus for the liquefaction of low-boiling gases, in which no cryogenic external refrigeration is required.

Another object of the present invention is to provide such a method and apparatus, in which a minimum number of expansion engines is used.

A further object of the present invention is the provision of such a method and apparatus, in which the warming curve of the gas is caused to approach congruency with the cooling curve of the gas.

Still another object of the present invention is to provide such a method and apparatus, in which substantial savings of the cost of energy will be enjoyed.

A still further object of the present invention is the provision of such a method and apparatus, in combination with an air separation unit.

Another object of the present invention is the provision of such a method and apparatus, of particular utility for the liquefaction of nitrogen.

Finally, it is an object of the present invention is the provision of such an apparatus which will be dependable and relatively cost effective, simple to maintain and operate, and rugged and durable in use.

SUMMARY OF THE INVENTION

These and other objects of the present invention are achieved by a method and apparatus according to the present invention, wherein the use of low temperature external refrigeration is avoided, and at the same time the number of expansion engines is kept to a minimum, by providing a dual pressure cycle in which an intermediate pressure portion of the feed is isentropically expanded and used to cool a relatively warm portion of the heat exchange means, while a high pressure portion of the feed is isentropically expanded, used to warm a cooler portion of the heat exchange means, and then again isentropically expanded to provide refrigeration for a still cooler portion of the heat exchange means. This third isentropic expansion is preferably to the lowest cycle pressure and temperature and may in some instances also produce liquefied gas.

As a result, the warming curve along the entire length of the heat exchange means of the present invention is brought into rather good congruency with the cooling curve, as shown in FIG. 2 of the accompanying drawings. This means, as pointed out above, that the present invention achieves a rather small temperature difference between the countercurrently flowing streams and hence improves the efficiency of operation, which results in substantial saving of the cost of the energy needed to produce the required compression. The saving in energy is at least about 3%; and, when compared to cycles with relatively low pressures below 50 bars, the saving rises to about 5%.

DISTINCTIONS FROM THE PRIOR ART

Relative to the disclosure of the patent of Smith et al., described above, the present invention presents at least these significant distinctions:

1. No external refrigeration unit operating at low temperature is required, with the advantages recited above.
2. Smith et al. is not a dual pressure cycle: the external refrigeration is applied to the same high pressure feed stream of which a portion is subjected to successive isentropic expansions.

Relative to Marshall et al., described above, the present invention has at least the following distinctions:

1. Although the scheme shown by Marshall et al. appears to be a dual pressure cycle, the warmest isentropic expansion is performed on a portion of the high pressure stream, not on the intermediate pressure stream as in the present invention.
2. In Marshall et al., the isentropic expansion of the intermediate pressure stream is performed at the lowest temperature level of the three isentropically expanded streams.
3. In Marshall et al., the refrigeration obtained by isentropic expansion is applied at three different temperature levels, and so four expansion engines are required.
4. In Marshall et al., the products of the two intermediate temperature isothermal expansions are applied to the same temperature level of the heat exchange means; whereas in the present invention the successively expanded material is applied to successively lower temperature portions of the heat exchange means.

Relative to Dobracki et al., described above, the present invention includes at least the following distinguishing features:

1. In Dobracki et al., the intermediate pressure stream is divided and isentropically expanded at two different temperature levels to provide refrigeration at two different temperature levels; but in the present invention, the intermediate pressure stream is isentropically expanded and used to provide refrigeration only at a relatively high temperature level.
2. In Dobracki et al., a portion of the high pressure stream is withdrawn and twice expanded isentropically, but with no heat exchange between these expansions. But in the present invention, the twice-expanded portion of the high pressure stream supplies refrigeration at two different temperature levels.
3. In Dobracki et al., the isentropically expanded portion of the high pressure stream and an isentropically expanded portion of the intermediate pressure stream supply refrigeration at the same temperature level, because they are merged; but in the present invention, the three isentropically expanded streams supply refrigeration at three different temperature levels.

BRIEF DESCRIPTION OF THE DRAWINGS

Other features and advantages of the present invention will become apparent from the following description, taken in connection with the accompanying drawings, in which.

DEFINITIONS

Figure 1:
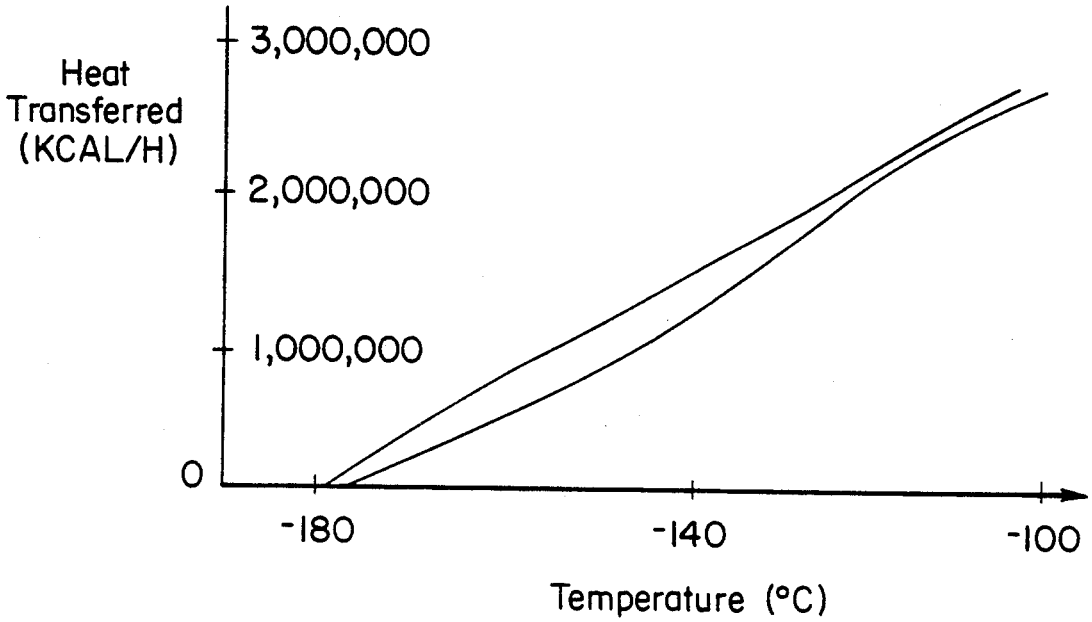
FIGS. 1 and 2, as pointed out above, show respectively graphs of heat transfer versus temperature when no correction of the warming curve according to the present invention is achieved, and when such a correction is required.
Figure 2:
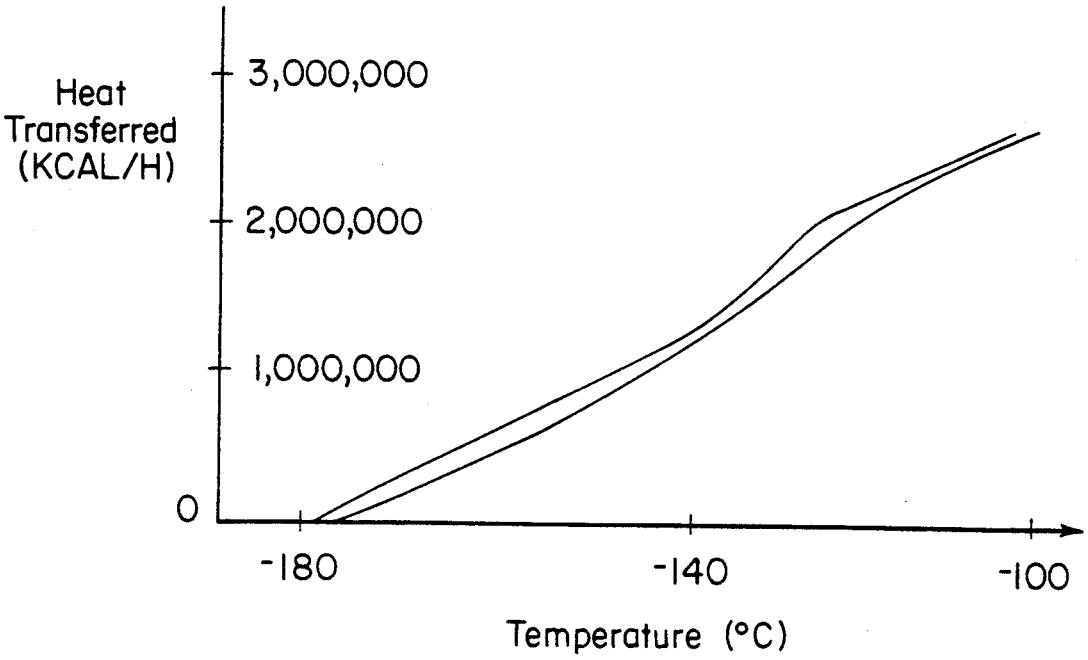

In the text that follows, all temperatures are given in degrees Centigrade.

Pressure is in bars absolute.

"Isentropic expansion" refers to expansion with work in an expansion machine which, although shown schematically in the drawings as turbo expanders, could nevertheless be any other type of expansion engine, such as reciprocating, etc.

Similarly, although the compressors are shown to be centrifugal compressors in the drawings, they could be screw compressors, reciprocating compressors, axial compressors, etc.

"Low-boiling gas" as used herein refers to a gas which, in its broadest sense, boils lower than −80° C. The preferred gases, however, are the atmospheric gases, i.e. those boiling no higher than oxygen, and those gases boiling lower than the atmospheric gases, e.g. hydrogen and helium. Particularly preferred is nitrogen or air, and the following description exemplifies the invention in connection with nitrogen. It is to be understood, however, that except as expressly claimed, the invention is not limited to use in connection with nitrogen.

DETAILED DESCRIPTION OF THE INVENTION

Figure 3:
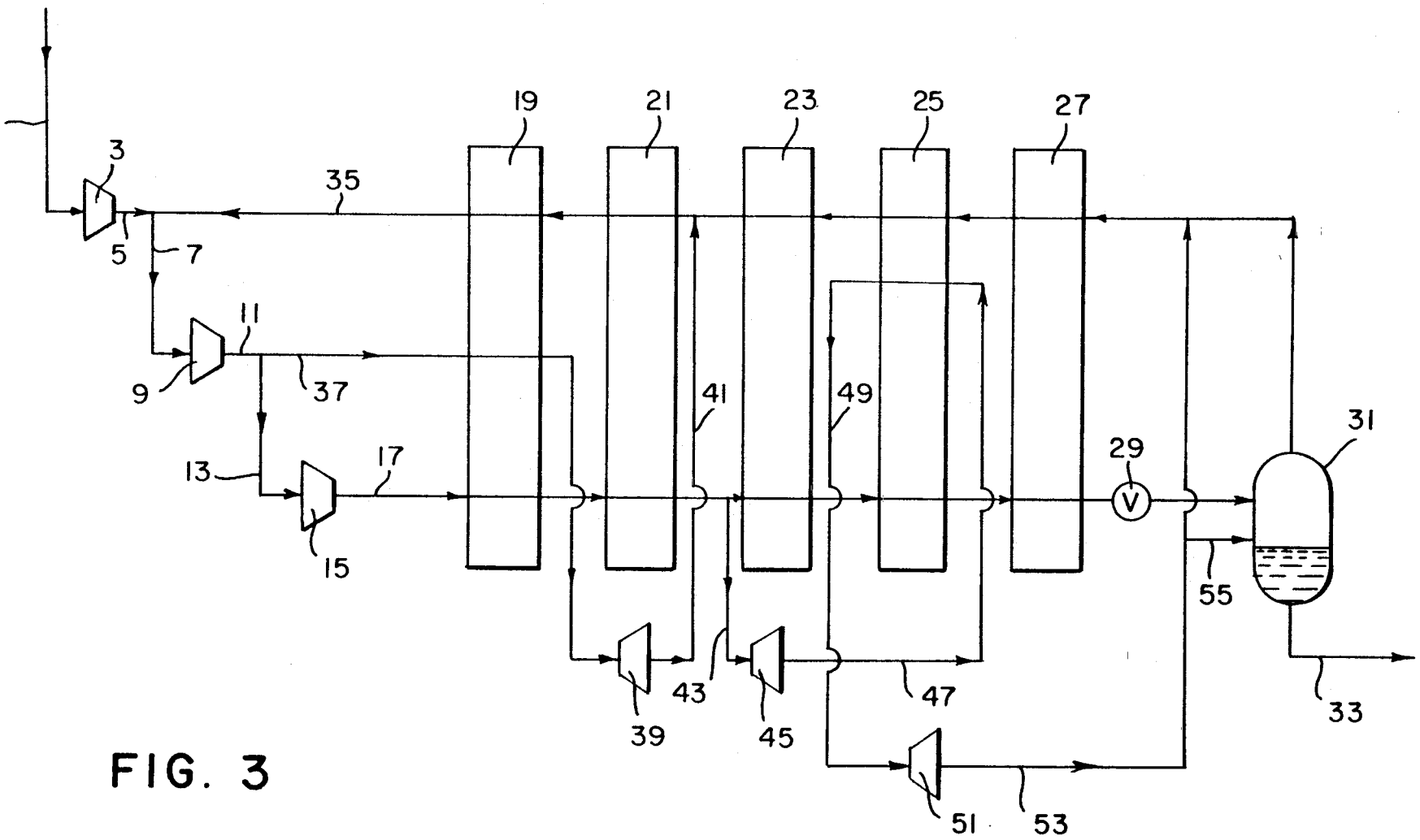
FIG. 3 is a schematic diagram of a liquefaction cycle according to the present invention.

Referring now to the drawings in greater detail, and first to FIG. 3 thereof, there is shown schematically a cycle for the liquefaction of nitrogen, in which gaseous nitrogen at a pressure only slightly higher than 1 bar enters through conduit 1 and is compressed to about 5 bars in compressor 3. The nitrogen thus leaves compressor 3 through conduit 5 at the lowest cycle pressure. This low pressure nitrogen, flowing through conduit 7, is further compressed to an intermediate pressure in a compressor 9, which it leaves through conduit 11 at a pressure of about 36 bars and a temperature of 25°. This intermediate pressure stream is divided and a portion in conduit 13 is compressed in compressor 15 to a high pressure of 76 bars and a temperature of 25° and then flows via conduit 17 through the heat exchange means, illustrated in the drawings as a series of successively colder heat exchangers 19, 21, 23, 25 and 27. It is of course to be understood that this representation of the heat exchange means is diagrammatic only: separate heat exchangers could be used, or one continuous heat exchanger. They are shown as separate heat exchangers for convenience of description.

The high pressure feed leaving the coldest heat exchanger 27 is subjected to isenthalpic expansion in a Joule-Thomson expander 29, in which it is partially liquefied, the mixed liquid and vapor being fed to a phase separator 31 from which liquid nitrogen can be withdrawn through conduit 33. Of course this high pressure feed stream can instead be expanded optionally in a dense-fluid expander to let down the pressure with minimal flash loss. The gaseous nitrogen leaves separator 31 through conduit 35 and is returned in countercurrent heat exchange with the feed to the warm end of the heat exchange means, whence it rejoins the make-up gas in conduit 7. In other words, the unliquefied nitrogen is recycled.

The high pressure stream in conduit 17 reaches the expander 29 at a temperature of about −177°, and is expanded almost to the lowest cycle pressure, i.e. to 5 bars, and a temperature of −179°, at which temperature its unliquefied portion from separator 31 enters the coldest heat exchanger 27. It is warmed in exchanger 27 to −140°, is warmed in exchanger 25 to −130°, is warmed in exchanger 23 to −95°, in exchanger 21 to −28° and in exchanger 19 to +22°.

A portion of the intermediate pressure feed, instead of passing through conduit 13, is diverted through conduit 37, wherein it has, as previously indicated, a pressure of 36 bars and a temperature of +25°. This intermediate pressure stream is cooled in exchanger 19 to −25°, and then is isentropically expanded in expander 39 to the lowest cycle pressure, 5 bars, and a temperature of −95°. This expanded stream passes through conduit 41 to rejoin the stream in conduit 35 passing to the warm end of the heat exchange means, to be recycled.

A portion of the high pressure feed is withdrawn from between exchangers 21 and 23, at a pressure of 76 bars and a temperature of −90°, through a conduit 43 and is isentropically expanded in an expander 45 to a pressure of 24 bars and a temperature of −140°, in which condition it is fed through a conduit 47 to the cold end of exchanger 25, which it leaves through a conduit 49 at a pressure of 24 bars and a temperature of −130°, and enters an expansion engine 51 in which it undergoes further isentropic expansion to the lowest cycle temperature of −179° and almost to the lowest cycle pressure of 5 bars. This stream passes through conduit 53 whence it joins the gas in conduit 35 for return to the warmest end of the heat exchange means; but if this stream contains liquid, then it can instead be fed through conduit 55 to phase separator 31.

Figure 4:
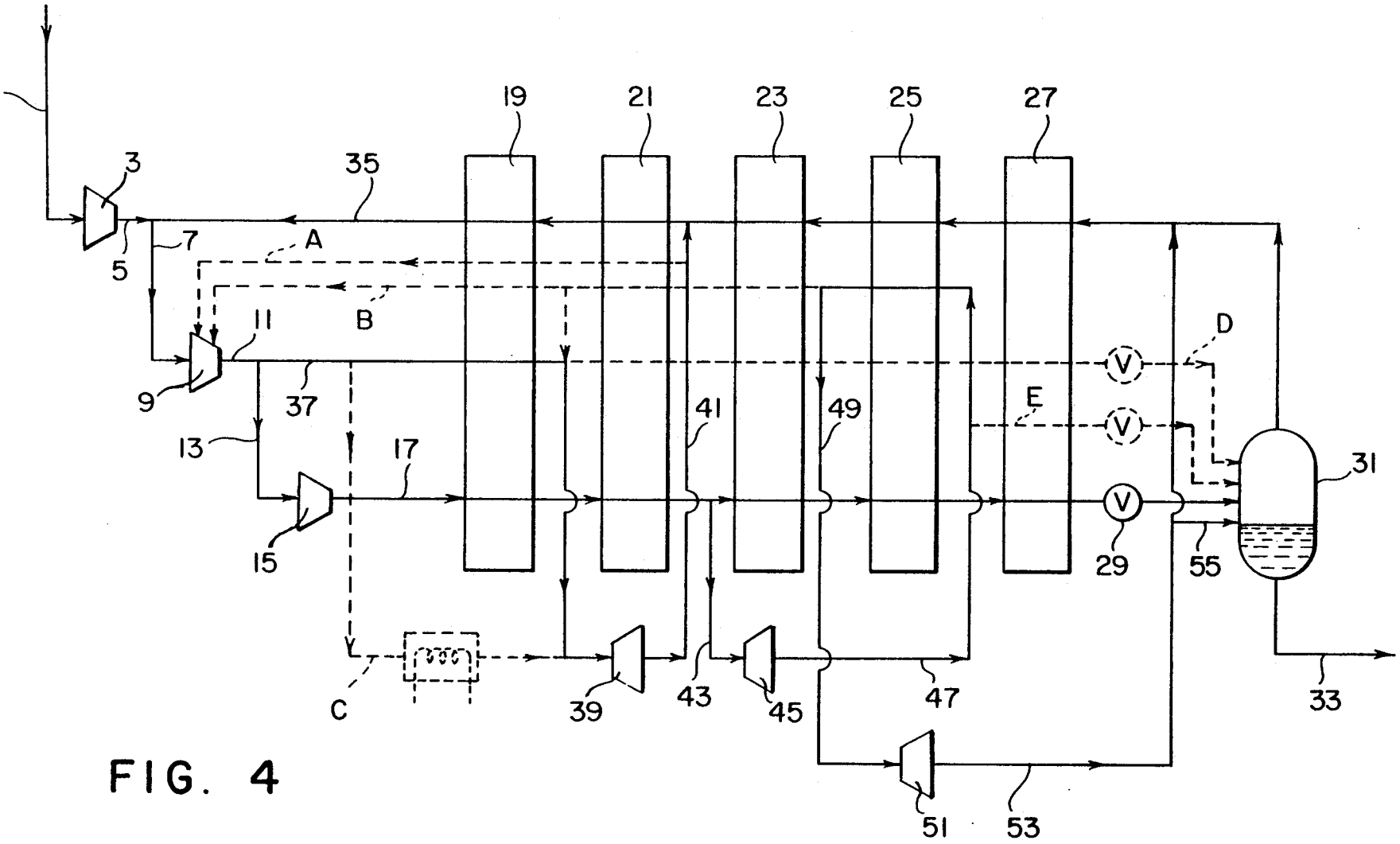
FIG. 4 is a view similar to FIG. 2 but which collates FIGS. 4A–4E, which follow.

As previously indicated, FIG. 4 shows the collation of FIGS. 4A–4E and so provides, at a glance, an overview of the various ways in which the cycle can be modified, as well as showing the ways in which FIGS. 4A–4E differ from FIG. 3 and from each other.

Figure 4A:
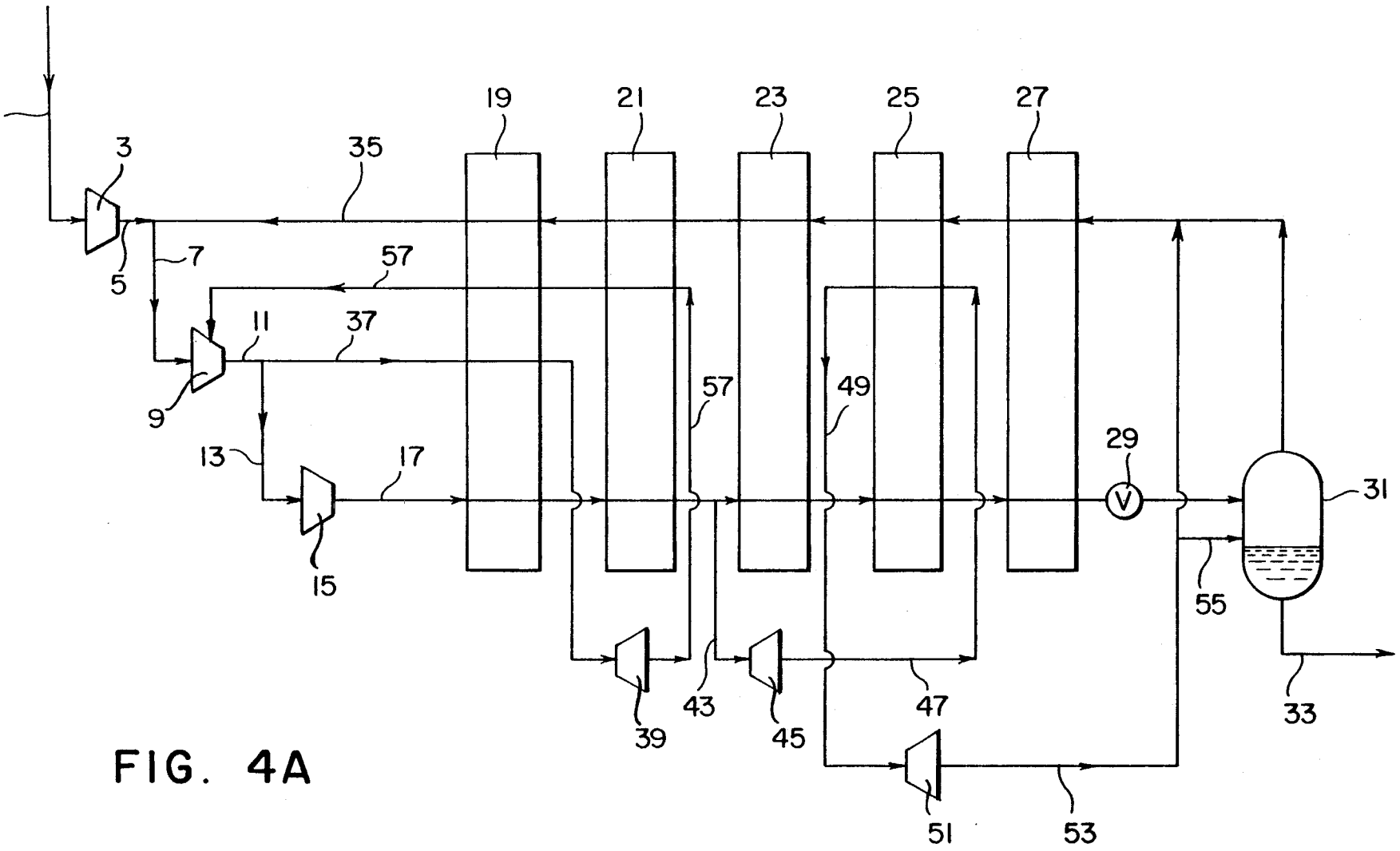
FIGS. 4A–4E are views similar to FIG. 3, but showing modified embodiments of the cycle according to the present invention.

Referring then to FIG. 4A, it will be seen that this cycle differs from that of FIG. 3, in that, instead of expanding to the lowest pressure of the cycle in expansion engine 39 and merging the expanded stream with a stream of similar pressure in conduit 35, the intermediate pressure stream is expanded in engine 39 only to a pressure of 10 bars and so is conveyed by conduit 57 separately through the exchangers 21 and 19 in that order, and then, because it is intermediate the pressure in conduits 5 and 13, is fed interstage to the compressor 7 for recycling.

Figure 4B:
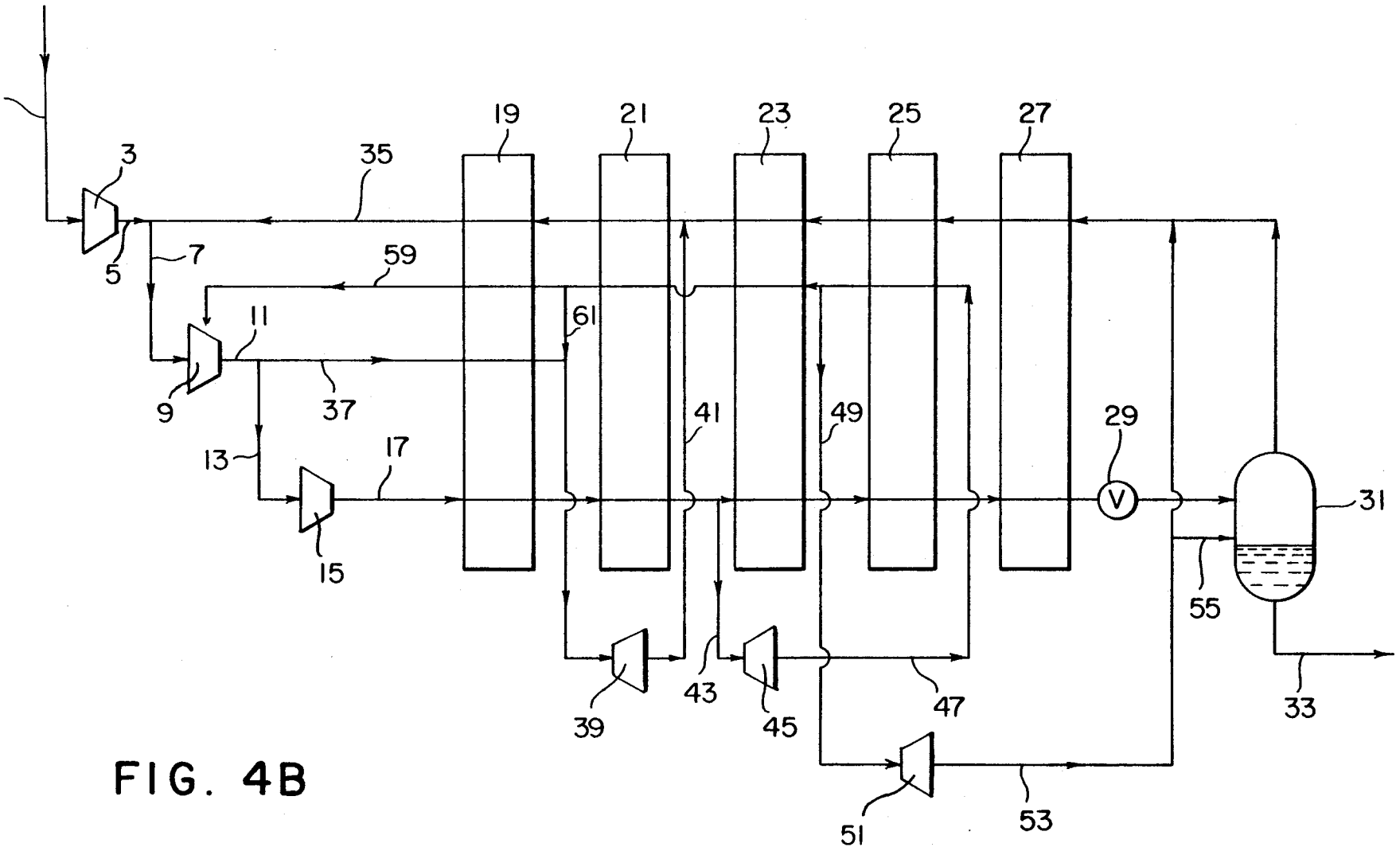

FIG. 4B differs from FIG. 3 in that a portion of the high pressure gas expanded in engine 45 and passing through conduit 47 to cool exchanger 25, is diverted from the conduit 49 that would carry all of it to engine 51; and this diverted portion passes through exchangers 23, 21 and 19 in that order via conduit 59, if it is intermediate in pressure between the pressures prevailing in conduits 5 and 13, in which case it is fed to compressor 7 interstage thereof.

But if the material in conduit 47 is at the intermediate pressure prevailing in conduit 37, then after passing through exchangers 23 and 21 in that order, it is merged into conduit 37 for passage through exchanger 19 and recycle.

Figure 4C:
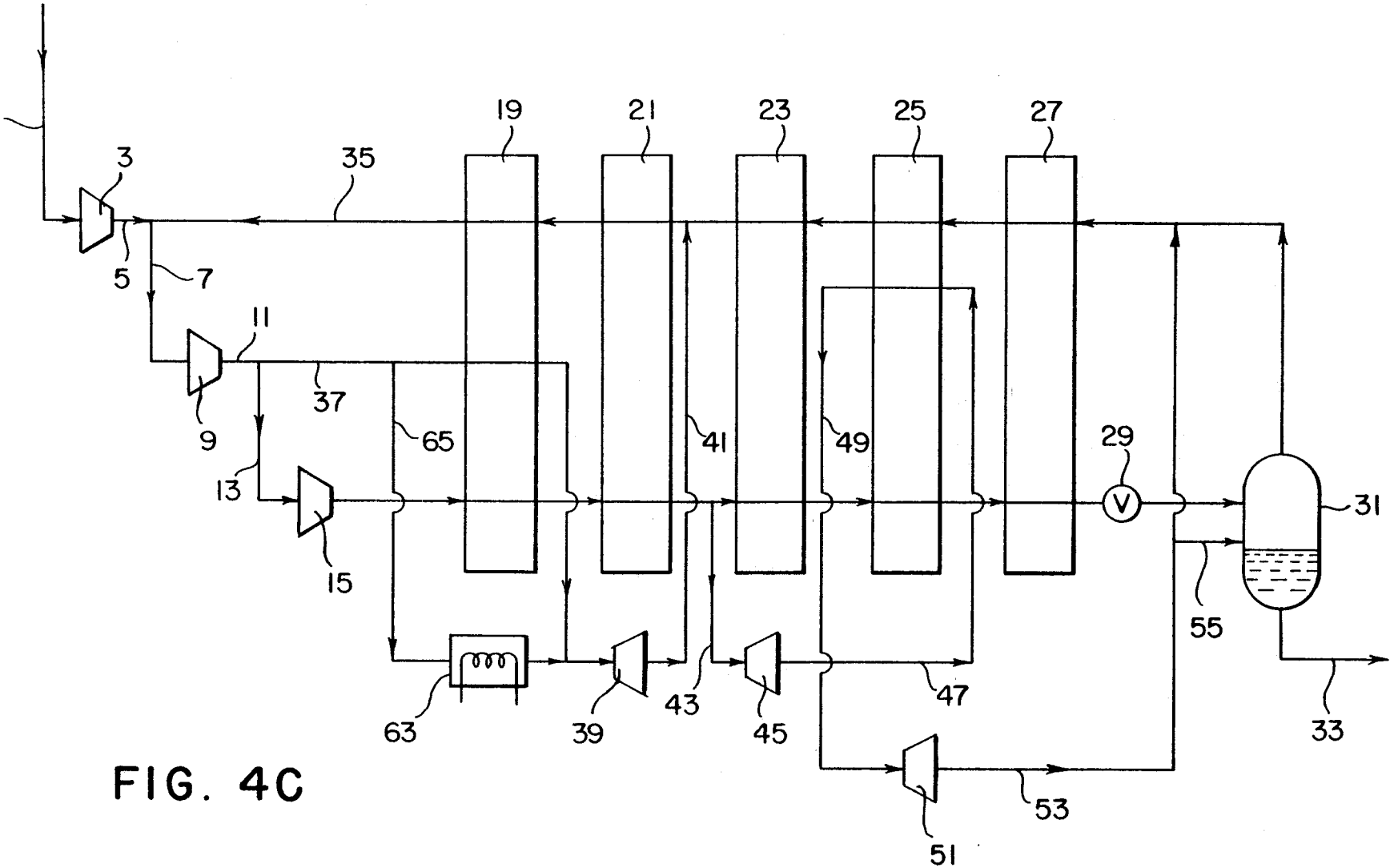

The cycle of FIG. 4C differs from that of FIG. 3, by the addition of a relatively warm level external refrigeration at 63. A portion of the intermediate pressure stream is diverted from conduit 37 whence it passes through conduit 65 and through external refrigeration 63 and then rejoins conduit 37 prior to entry into expansion engine 39, thereby bypassing heat exchanger 19.

It will be recalled that it was pointed out at the outset that the lack of low temperature external refrigeration in the present invention is a distinguishing feature compared to the patent to Smith et al. The presence of external refrigeration 63 does not violate that principle: the outlet temperature of 63 is higher than −45°, and so cryogenic equipment need not be used at this point, with considerable saving of cost. Also, common refrigerants such as ammonia, Freon, mixed hydrocarbons, etc. can be used.

Figure 4D:
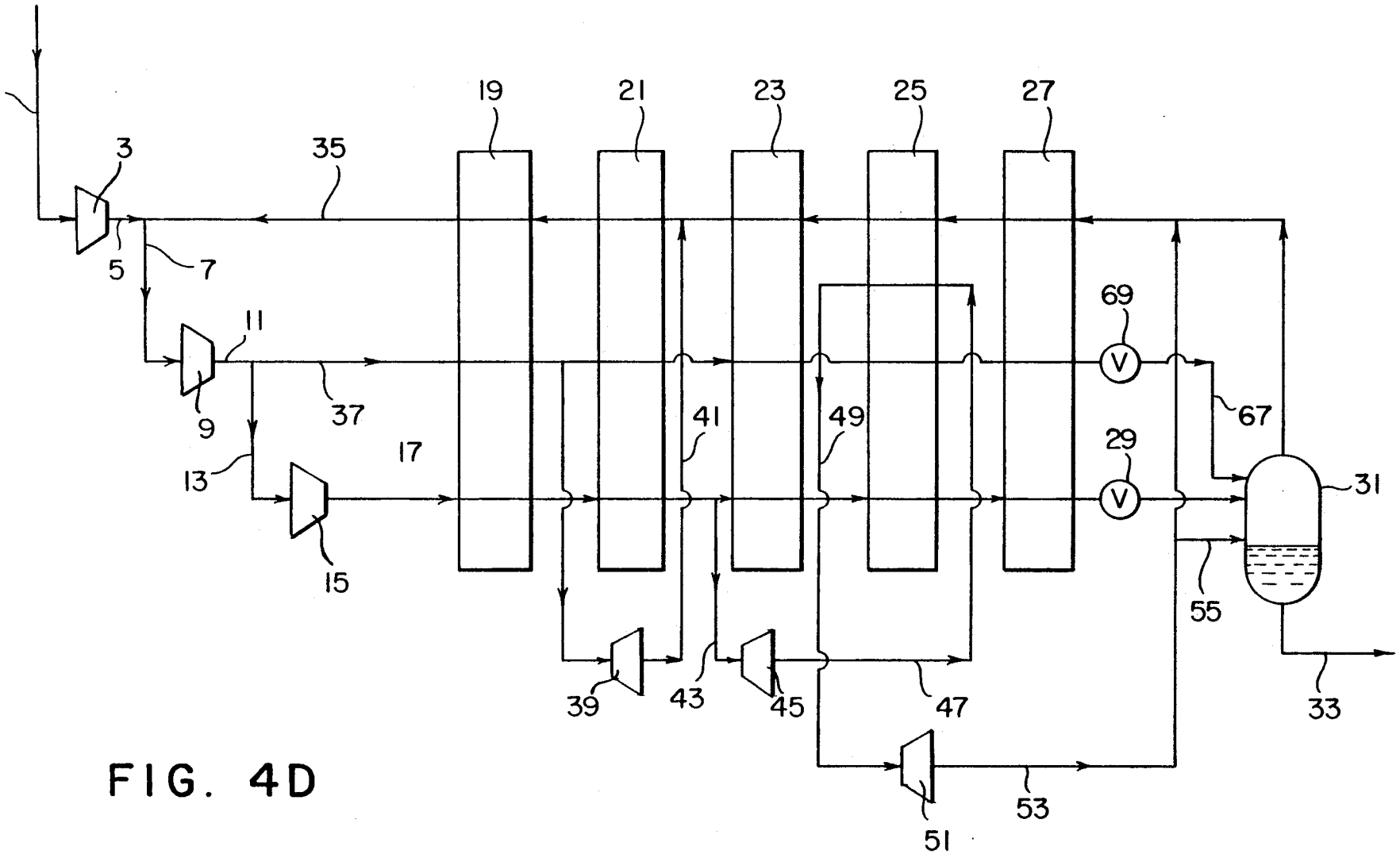

The cycle of FIG. 4D differs from that of FIG. 3 by the treatment of the intermediate pressure stream. In FIG. 4D, instead of the entire intermediate pressure stream passing from conduit 37 to expander 39, a portion is branched off after passage through exchanger 19 and proceeds directly through exchangers 21, 23, 25 and 27 in that order, and then is isenthalpically expanded in a Joule-Thomson expander 69 to slightly over 5 bars, and is introduced into liquid separator 31.

Figure 4E:
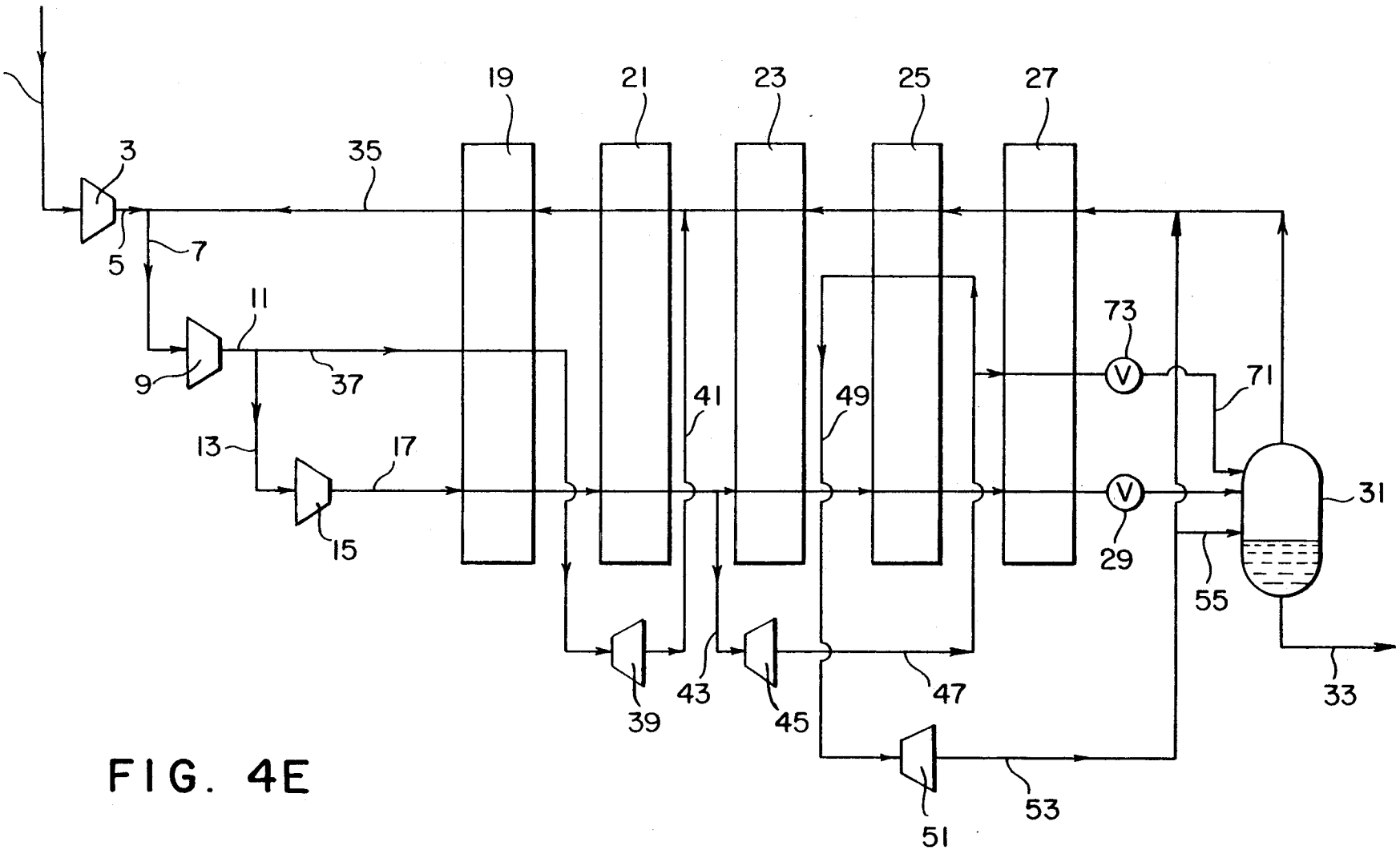

The cycle of FIG. 4E differs from that of FIG. 3 in that a portion of the output of expander 45 is diverted from conduit 47 into a conduit 71 in which it passes through exchanger 27 and is isenthalpically expanded in Joule-Thompson expander 73, to slightly over 5 bars, prior to introduction into phase separator 31.

Figure 5:
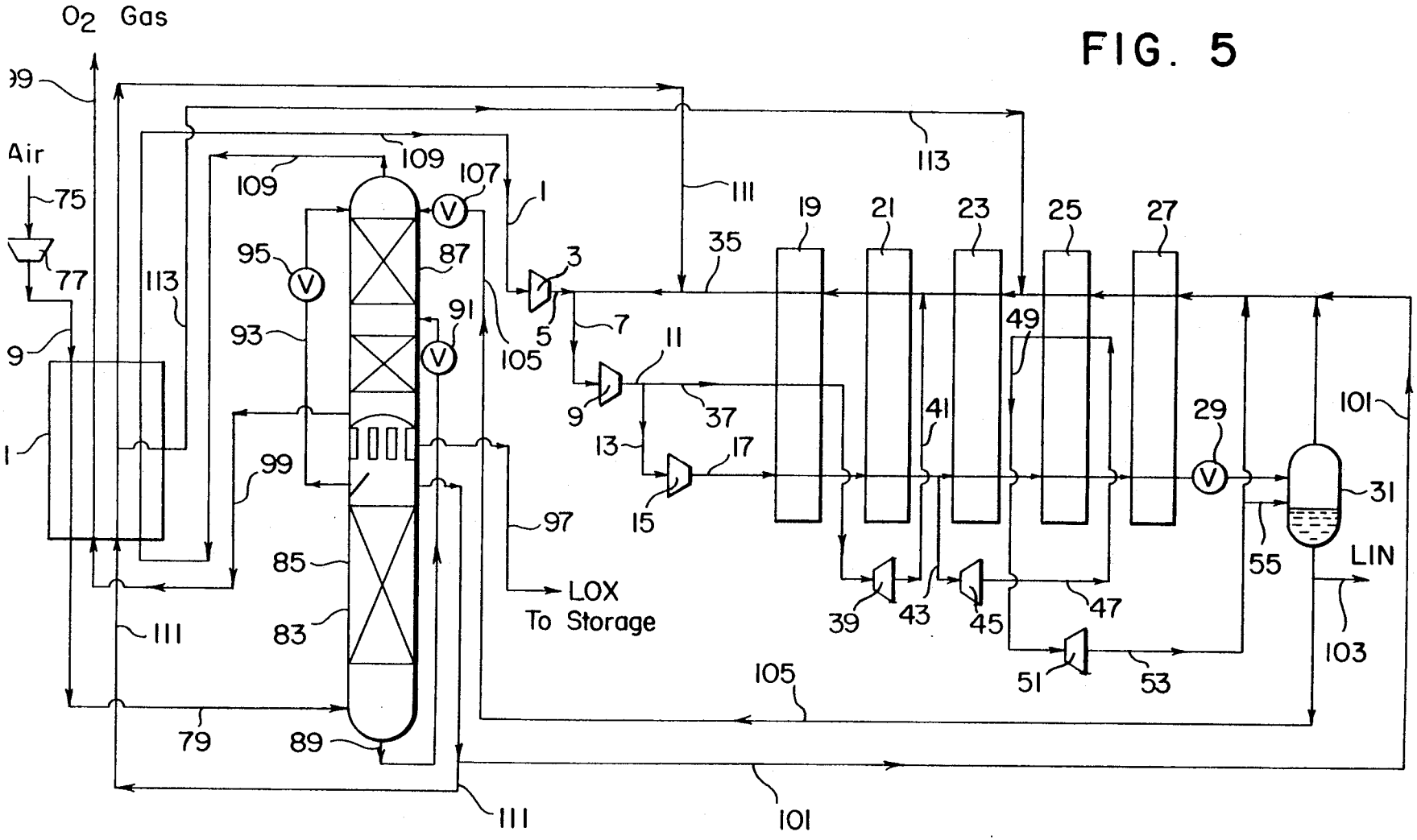
FIG. 5 is a view similar to FIG. 3, but showing the incorporation of the liquefaction cycle in an air separation unit.

FIG. 5 shows the combination of a liquefaction cycle according to the present invention with an air separation unit that is otherwise conventional.

Beginning at the left of FIG. 5, therefore, it will be seen that air introduced through conduit 75 is compressed in compressor 77 and passes via conduit 79 through heat exchanger 81, wherein it is cooled to about the liquefaction temperature of air, whereafter it is introduced into the bottom of a high pressure stage 83 of a two-stage air distillation column 85 of the usual construction, in which a low pressure stage 87 surmounts high pressure stage 83 and shares a common condenser-reboiler between the two. The pressure in high pressure stage 83 is substantially the same as the lowest pressure of the liquefaction cycle, i.e. 5 bars.

In conventional fashion, oxygen-rich liquid is withdrawn from the sump of high pressure stage 83 via conduit 89, is expanded isenthalpically in Joule-Thomson expander 91 and introduced into low pressure stage 87 at the appropriate composition level. As is also conventional, liquid nitrogen is withdrawn from the top of high pressure stage 83 via conduit 93, expanded isenthalpically in Joule-Thomson expander 95, to just above atmospheric pressure, and is introduced overhead in low pressure stage 87 as reflux.

As is also conventional, liquid oxygen from the sump of low pressure stage 87 is withdrawn via conduit 97 to storage. Gaseous oxygen from the bottom of low pressure stage 87 is withdrawn via conduit 99 and its refrigeration recovered in heat exchanger 81, whence the gaseous oxygen passes to an appropriate utilization.

In accordance with the invention, however, gaseous nitrogen is withdrawn from the top of high pressure stage 83 via conduit 101 and is merged with a stream of similar composition, temperature and pressure in conduit 35.

Also in accordance with the present invention, the liquid nitrogen from phase separator 31 that leaves through conduit 33 is divided, a portion passing via conduit 103 to conventional storage (with any needed pressure adjustment as for example by expansion) and the remainder passing in liquid phase through conduit 105. The liquid in conduit 105, at a pressure of 5 bars, is isenthalpically expanded through Joule-Thompson expander 107 to the lower pressure of low pressure stage 87 and is introduced into the top thereof as further reflux.

Gaseous overhead from low pressure stage 87 flows via conduit 109 through heat exchanger 81 and thence to conduit wherein it serves as make-up for the nitrogen refrigeration cycle.

Also in accordance with the present invention, a portion of the gaseous nitrogen removed via conduit 101 is branched from conduit 101 through conduit 111, and passes at least part way through exchanger 81 wherein its refrigeration is recovered. Material in conduit ;11 then serves as a warm make-up for the intermediate pressure stream. For this purpose, it can be fed directly into conduit 13, as it is already at the required pressure of 5 bars.

A portion of the gaseous nitrogen undergoing warming in exchanger 81 can be withdrawn from conduit 111 at an appropriate temperature level via conduit 113 and merged with the material at the corresponding pressure and temperature level in conduit 35, e.g. between exchangers 23 and 25.

As indicated above, the temperatures and pressures that have been particularly recited are exemplary only, and of course apply only to a nitrogen cycle. In general, however, the high pressure material leaving compressor 15 should have a pressure in the range of 20 to 100 bars; that leaving compressor 9 should have a pressure in the range of 10 to 50 bars and that leaving expansion engine 45 should have a pressure in the range of 10 to 80 bars.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a method of liquefying a low-boiling gas, in which said gas is compressed to a high pressure, is cooled in heat exchange means and is expanded to a low pressure to liquefy at least a portion of the same; the improvement comprising compressing a portion of said gas to an intermediate pressure between said high and low pressures, isentropically expanding said intermediate pressure gas at a first temperature and using the isentropically expanded gas to cool a relatively warm portion of said heat exchange means and then recycling said isentropically expanded gas, isentropically expanding a portion of said high pressure gas at a second temperature and using the same to cool a relatively cool portion of said heat exchange means and then again isentropically expanding at least some of the latter portion of gas at a third temperature to said low pressure and returning the same through the heat exchange means to cool the heat exchange means and then recycling the latter gas, said first temperature being higher than said second temperature and said second temperature being higher than said third temperature.

2. A method as claimed in claim 1, and cooling said intermediate pressure gas in the warm end of said heat exchange means prior to isentropic expansion thereof.

3. A method as claimed in claim 2, and cooling the high pressure gas to a lower temperature than the intermediate pressure gas, in said heat exchange means, prior to isentropic expansion of said portion of said high pressure gas.

4. A method as claimed in claim 1, and cooling said high pressure gas in a relatively warm portion of said heat exchange means prior to isentropic expansion of said portion thereof.

5. A method as claimed in claim 1, and separating liquid from the last-mentioned isentropically expanded gas.

6. A method as claimed in claim 1, in which said low-boiling gas has a boiling point no higher than that of oxygen.

7. A method as claimed in claim 6, in which said low-boiling gas is nitrogen.

8. A method as claimed in claim 6, in which said low-boiling gas is air.

9. A method as claimed in claim 1, wherein said intermediate pressure stream undergoes said isentropic expansion to said low pressure.

10. A method as claimed in claim 1, wherein said intermediate pressure gas undergoes said isentropic expansion to a pressure between said low pressure and said intermediate pressure.

11. A method as claimed in claim 1, wherein a portion of said gas between the last two isentropic expansions is diverted prior to the last isentropic expansion and is returned through said heat exchange means to a warm end thereof and recycled.

12. A method as claimed in claim 1, wherein a portion of said gas between the last two isentropic expansions is diverted prior to the last isentropic expansion and is passed through a portion of said heat exchange means to cool the same but is withdrawn from said heat exchange means prior to reaching a warm end thereof and is recycled with said intermediate pressure gas.

13. A method as claimed in claim 1, further comprising subjecting a portion of said intermediate pressure gas to external refrigeration at a temperature level above −45° C. prior to said isentropic expansion thereof.

14. A method as claimed in claim 13, wherein the portion of said intermediate gas that is subjected to external refrigeration bypasses said heat exchange means prior to said isentropic expansion thereof and the remainder of said intermediate pressure gas passes through and is cooled in a warm end of said refrigeration means prior to said isentropic expansion thereof.

15. A method as claimed in claim 1, wherein a portion of said intermediate pressure gas bypasses said isentropic expansion thereof and instead continues through said heat exchange means to a cold end thereof and is expanded.

16. A method as claimed in claim 1, wherein a portion of said gas between the last two isentropic expansions is diverted prior to the last isentropic expansion, cooled in a cold end of said heat exchange means and expanded.

17. In an air separation method comprising compressing and cooling air, introducing the cooled air into a high pressure stage of a two-stage air distillation column comprising also a low pressure stage, withdrawing oxygen-rich liquid from the lower end of the high pressure stage and expanding the same and introducing the same into said low pressure stage for separation in said low pressure stage, withdrawing liquid nitrogen from the high pressure stage and expanding and introducing the same into the low pressure stage as reflux, and withdrawing nitrogen from the top of the low pressure stage; the improvement comprising using said gaseous nitrogen as feed to the liquefaction cycle of claim 1.

18. An air separation method as claimed in claim 17, further comprising withdrawing gaseous nitrogen from the top of the high pressure stage, using the same to cool said air, and then merging the same with gas in said liquefaction cycle at said low pressure of said cycle.

19. An air separation method as claimed in claim 17, wherein liquid nitrogen produced in said liquefaction cycle is expanded and supplied to said low pressure stage as reflux.

20. An air separation method as claimed in claim 17, wherein gaseous nitrogen from said high pressure stage is used first to cool incoming air and then to cool a warmer portion of said heat exchange means.

21. A method as claimed in claim 17, wherein said high pressure stage is at said low pressure of said liquefaction cycle.

22. In apparatus for liquefying a low-boiling gas, in which said gas is compressed to a high pressure, is cooled in heat exchange means and is expanded to a low pressure to condense at least a portion of the same to liquid, the improvement comprising means for compressing a portion of said gas to an intermediate pressure between said high and low pressures, means for isentropically expanding said intermediate pressure gas at a first temperature and for using the isentropically expanded gas to cool a relatively warm portion of said heat exchange means and for then recycling said isentropically expanded gas, means for isentropically expanding a portion of said high pressure gas at a second temperature and for using the same to cool a relatively cool portion of said heat exchange means and for then again isentropically expanding at least some of the latter portion of gas at a third temperature to said low pressure and for returning the same through the heat exchange means to cool the heat exchange means and for then recycling the latter gas, said first temperature being higher than said second temperature and said second temperature being higher than said third temperature.

23. Apparatus as claimed in claim 22, and means for cooling said intermediate pressure gas in the warm end of said heat exchange means prior to isentropic expansion thereof.

24. Apparatus as claimed in claim 23, and means for cooling the high pressure gas to a lower temperature than the intermediate pressure gas, in said heat exchange means, prior to isentropic expansion of said portion of said high pressure gas.

25. Apparatus as claimed in claim 22, and means for cooling said high pressure gas in a relatively warm portion of said heat exchange means prior to isentropic expansion of said portion thereof.

26. Apparatus as claimed in claim 22, and means for separating liquid from the last-mentioned isentropically expanded gas.

27. Apparatus as claimed in claim 22, wherein said intermediate pressure stream undergoes said isentropic expansion to said low pressure.

28. Apparatus as claimed in claim 22, wherein said intermediate pressure gas undergoes said isentropic expansion to a pressure between said low pressure and said intermediate pressure.

29. Apparatus as claimed in claim 22, further comprising means for diverting a portion of said gas between the last two isentropic expansions prior to the last isentropic expansion and for returning the same through said heat exchange means to a warm end thereof for recycle.

30. Apparatus as claimed in claim 22, further comprising means for diverting a portion of said gas between the last two isentropic expansions prior to the last isentropic expansion and for passing the same through a portion of said heat exchange means to cool the same but for withdrawing the same from said heat exchange means prior to reaching a warm end thereof and for recycling the same with said intermediate pressure gas.

31. Apparatus as claimed in claim 22, further comprising means for subjecting a portion of said intermediate pressure gas to external refrigeration at a temperature level above −45° C. prior to said isentropic expansion thereof.

32. Apparatus as claimed in claim 31, wherein the portion of said intermediate gas that is subjected to external refrigeration bypasses said heat exchange means prior to said isentropic expansion thereof and the remainder of said intermediate pressure gas passes through and is cooled in a warm end of said refrigeration means prior to said isentropic expansion thereof.

33. Apparatus as claimed in claim 22, further comprising means for bypassing a portion of said intermediate pressure gas past said isentropic expansion thereof and for instead conveying the same through said heat exchange means to a cold end thereof and for expanding the same.

34. Apparatus as claimed in claim 22, further comprising means for diverting a portion of said gas between the last two isentropic expansions prior to the last isentropic expansion, and for cooling the same in a cold end of said heat exchange means and for expanding the same.

35. An air separation apparatus comprising means compressing and cooling air to partially liquefy the same, and for introducing the partially liquefied air into a high pressure stage of a two-stage air distillation column comprising also a low pressure stage, and for withdrawing oxygen-rich liquid from the lower end of the high pressure stage and expanding the same and for introducing the same into said low pressure stage for separation in said low pressure stage, and for withdrawing liquid nitrogen from the high pressure stage and for expanding and introducing the same into the low pressure stage as reflux, and for withdrawing nitrogen from the top of the low pressure stage; the improvement comprising means for using said gaseous nitrogen as feed to the liquefaction apparatus of claim 22.

36. An air separation apparatus as claimed in claim 35, further comprising means for withdrawing gaseous nitrogen from the top of the high pressure stage, means for using the same to cool said air, and means for then merging the same with gas in said liquefaction apparatus at said low pressure of said liquefaction apparatus.

37. An air separation apparatus as claimed in claim 35, further comprising means whereby liquid nitrogen from said phase separation is expanded and supplied to said low pressure stage as reflux.

38. An air separation apparatus as claimed in claim 35, further comprising means whereby gaseous nitrogen from said high pressure stage is used first to cool incoming air and then to cool a warmer portion of said heat exchange means.

39. An air separation apparatus as claimed in claim 35, wherein said high pressure stage is at said low pressure of said liquefaction apparatus.

* * * * *